US005184437A

United States Patent [19]

Woong et al.

[11] Patent Number: 5,184,437

[45] Date of Patent: Feb. 9, 1993

[54] DAMP-PROOF CONSTRUCTION

[76] Inventors: Choi J. Woong, 551-33 Banpo-dong, Seocho-gu; Chai Sam Park, 213-22 Jun nong-dong, Dongdaemun-gu, both of Seoul, Rep. of Korea

[21] Appl. No.: 750,359

[22] Filed: Aug. 27, 1991

[30] Foreign Application Priority Data

Aug. 29, 1990 [KR] Rep. of Korea ..... 90-13399

[51] Int. Cl.[5] ..... E04B 1/64

[52] U.S. Cl. ..... 52/169.5

[58] Field of Search ..... 52/169.5, 274, 287, 52/303; 405/43

[56] References Cited

U.S. PATENT DOCUMENTS

| | | | |
|---|---|---|---|
| 3,283,460 | 11/1966 | Patrick | 52/169.5 |
| 3,287,866 | 11/1966 | Bevilacqua | 52/169.5 |
| 4,612,742 | 9/1986 | Bevilacqua | 52/169.5 |
| 4,869,032 | 9/1989 | Geske | 52/169.5 |

FOREIGN PATENT DOCUMENTS

| | | | |
|---|---|---|---|
| 3631176 | 5/1987 | Fed. Rep. of Germany | 52/169.5 |

*Primary Examiner*—David A. Scherbel
*Assistant Examiner*—Joanne C. Downs
*Attorney, Agent, or Firm*—Lowe, Price, LeBlanc & Becker

[57] ABSTRACT

A damp-proof construction for building underground or subways includes damp-proof bricks formed of plastics are disposed on an underground base surface and adjacent an outer wall with spaces for drainage therebetween. An inner wall of cement bricks may be mounted on the damp-proof bricks. After the inner wall is fabricated, plastic palettes are mounted on the underground base surface. Non-woven fabrics may be layered on the plastic palette layer. A mortar or concrete as an upper protecting layer may be layered on the non-woven fabric layer. The damp-proof construction prevents moisture from entering building construction through capillary action.

8 Claims, 3 Drawing Sheets

DAMP-PROOF CONSTRUCTION

FIELD OF THE INVENTION

The present invention relates to water-proofing of building construction, and particularly to a damp-proof construction for building and subway construction employing a damp-proof brick and plastic-palette as damp-proof members.

BACKGROUND OF THE INVENTION

Underground rooms or subways are always dampened by the penetration of water through outer walls of the construction such that the penetrating water is collected on the bottom surface.

Then, the stagnated water rises up the inner wall by capillary action of the wall to spread to all of the wall.

The moisture content of the wall produces must and is harmful to the health.

SUMMARY OF THE INVENTION

The object of this invention is to provide a damp-proof method and assembly for building or subway construction which is able to prevent the capillary action of the walls and solve the above problem.

The present invention provides a damp-proof construction for underground or subway construction comprising:

damp-proof bricks 100 formed of plastic disposed on the base surface of the underground on the inside of the outer wall with space between adjacent bricks for drainage;

an inner wall of cement bricks is mounted on the damp-proof bricks. After the inner wall is fabricated, plastic palettes 200 are mounted on the whole base surface of the underground bottom. A non-woven fabric covers the plastic palette layer. A mortar or concrete as an upper protecting layer covers the non-woven fabric layer.

Further, the present invention provides a damp-proof brick and a plastic palette which is able to be applied for water proofing of the underground, subways or as an air drying tray.

The damp-proof brick of the present invention is formed by plastic materials and applied to the under part of an inner wall on an underground room's bottom.

The plastic palette of the present invention formed of plastic materials may be applied to the bottom of the underground as an air drying tray.

Additional objects and features of the present invention will be apparent from the following description, in which reference is made to the accompanying drawings.

DETAILED DESCRIPTION OF THE PREFERRED EMBODIMENT

Figure 1:
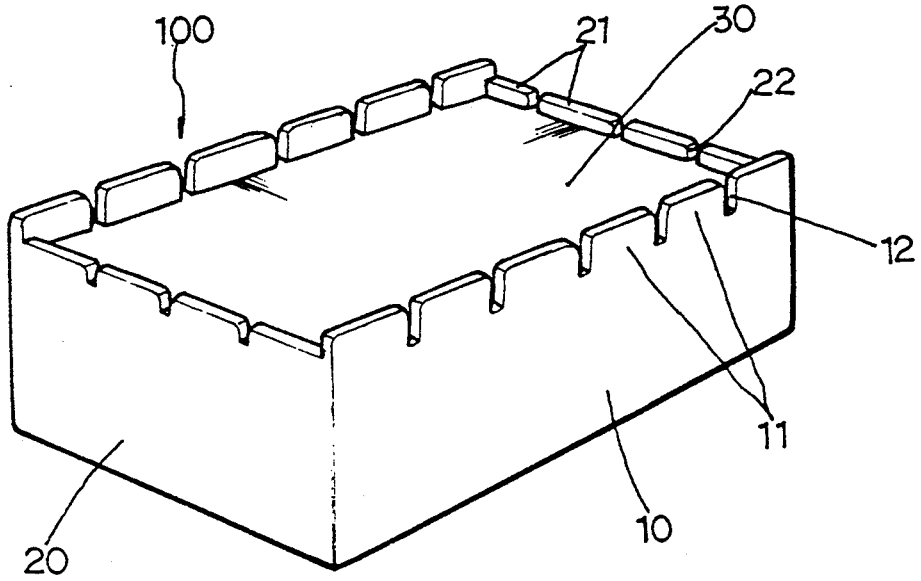
FIG. 1 is a perspective view of the damp-proof brick of a preferred embodiment of the invention.
Figure 2:
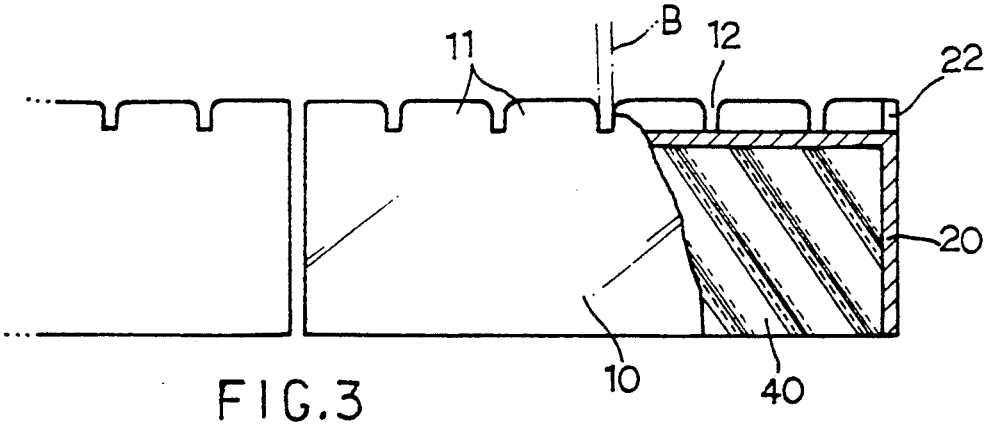
FIG. 2 is a partial vertical section of the damp-proof bricks of FIG. 1.
Figure 3:
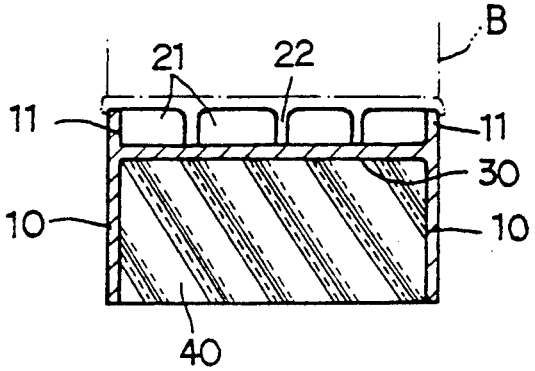
FIG. 3 is a transverse sectional view of FIG. 1.

Referring now to Figures of the drawings and with reference to FIGS. 1–3, a damp proof brick 100 of the present invention comprises; a hexahedron formed of plastics provided with a pair of side walls 10, a pair of end walls 20, an upper plate 30, an under space room 40 and a pair of side wall holder 11 and end wall holder 21 having grooves 12 and 22, respectively of constant intervals extending upwardly from the surface of upper plate 30.

The symbol B is a common cement block.

The end wall holder 21 of the damp-proof brick 100 is preferably shorter than the side wall holder 11 making it convenient for receiving the cement brick B.

The grooves 12 and 22 are formed for water discharge from the mortar.

Some joint protrusions or holes for mortar may be disposed on the upper plate 30 or surface of the side wall 10 and end wall 20.

Figure 4:
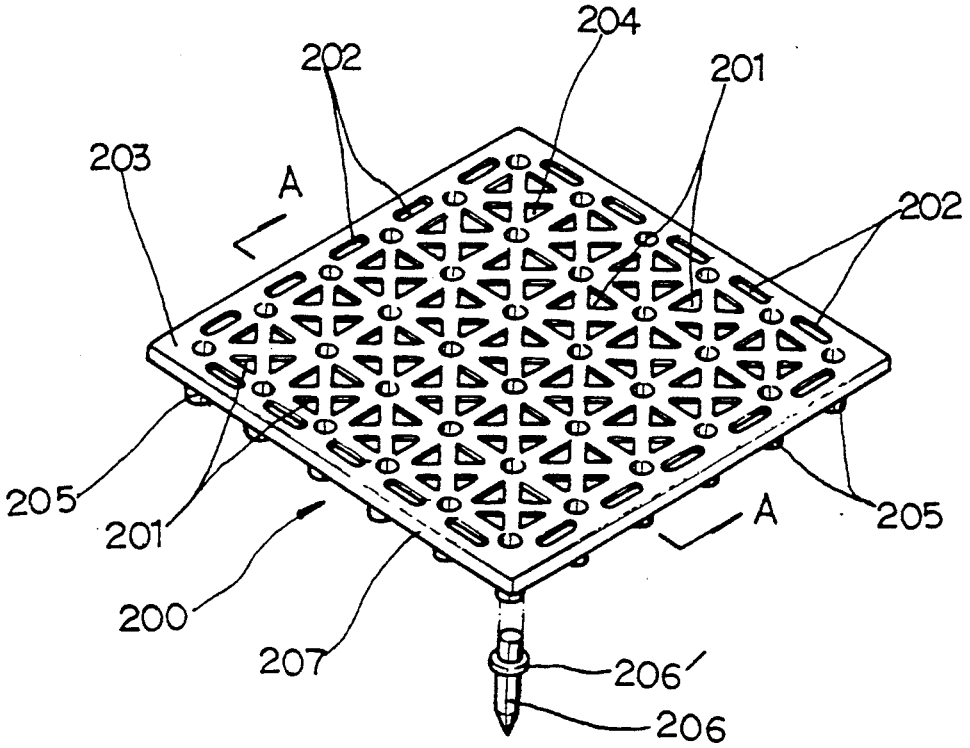
FIG. 4 is a perspective view of the plastic palette of a preferred embodiment of the invention.
Figure 5:
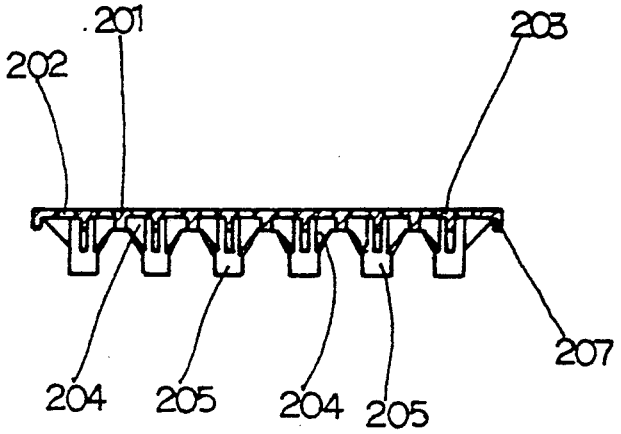
FIG. 5 is a cross sectional view along the A—A line of FIG. 4.

With reference to FIGS. 4–5, a plastic palette 200 of the present invention formed of plastic materials comprises a square fence like body plate 203 having a large number of triangle throughholes 201, a large number of rectangular holes 202; a large number of holder pipes 205 projecting below the body plate 203 with reinforced spacers 204 formed of a large upper and small under body at eight (8) direction. The conical under-shaped support member 206 having a support collar 206' is insertion coupled to control the height of the body 203. A reinforced frame 207 is formed on the surroundings of the body 203.

The plastic palette 200 may be applied to the surface of storage for deposit of cereals, goods and the damp-proof system of the present invention.

The reinforced spacers 204 are formed for the break-up and absorbtion of weight. The triangle-shaped through-hole 201 and the round rectangular hole 202 are also provided for dispersion and absorbtion of loading weight.

Thus, the plastic palette 200 of the present invention is very strong for load.

The large number of hole 201, 202 is beneficial by permitting air drying.

Figure 6:
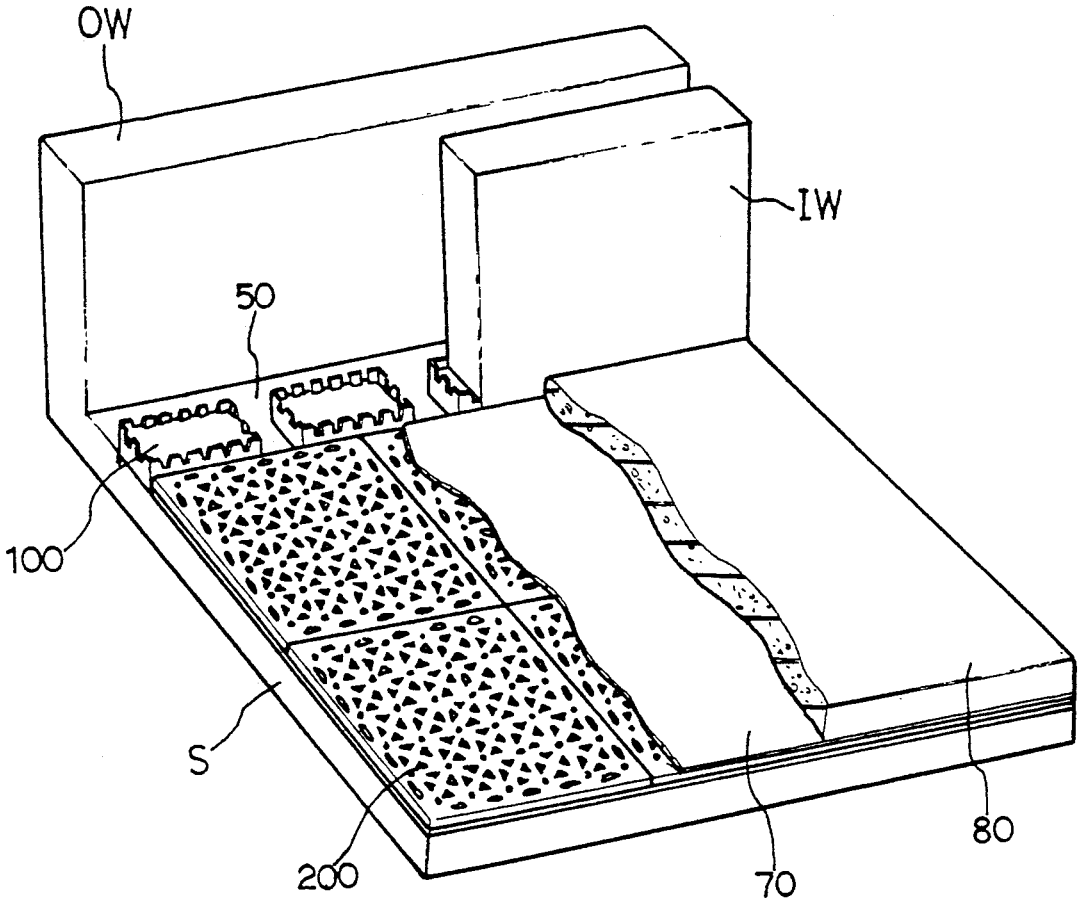
FIG. 6 is a partially cutaway perspective view of whole assembly detail of a preferred embodiment of the invention.
Figure 7:
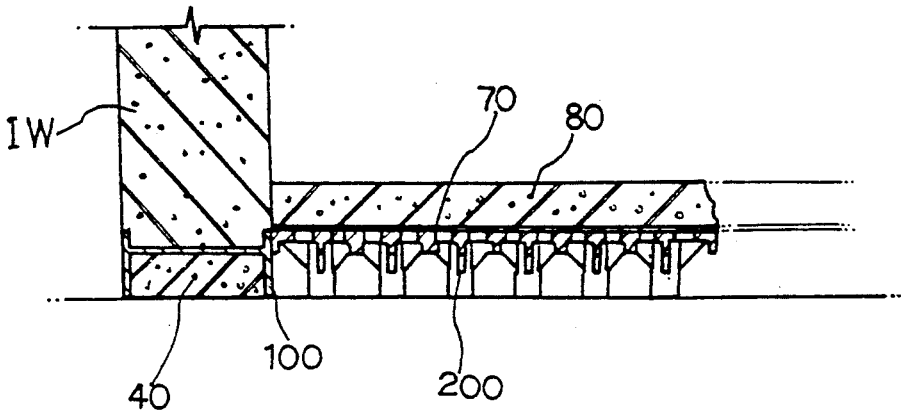
FIG. 7 is a cross sectional view of FIG. 6.

A damp-proof construction according to the present invention and shown in FIGS. 6 and 1 comprises, damp-proof bricks 100 disposed on the base surface of the underground S adjacent the outer wall OW leaving spaces for drainage 50. The inner wall IW of cement bricks B is mounted on the damp-proof bricks 100. After the inner wall IW is fabricated, the plastic palettes 200 are mounted on the whole surface of the underground bottom S. A non-woven fabric 70 is layered on the plastic palette layer 100. Then, a mortar or concrete upper bottom layer 80 is layered on the said non woven fabric layer 70.

The arrangement of the present invention is such that, a damp-proof system prevents the rising up of the moisture from a bottom surface. The damp-proof bricks 100 and palettes 200 provide an isolation action against the penetration of water. Stagnated water may be drained out through the spaces of drainage 50 between adjacent damp-proof bricks 100.

Thus, the damp-proof method according to the present invention may prevent capillary action of moisture from the penetrating water from the underground water, heavy rain or the earth's surface water into a building construction.

Although the present invention has been described in some detail by way of illustration and example for purposes of clarity of understanding it, it is understood that certain changes and modifications may be made within the spirit of the invention.

We claim:

1. A damp-proof construction for buildings and subways comprising:

a) a plurality of plastic bricks arranged adjacent an outer wall of a structure and on an underground surface of said structure, adjacent said plastic bricks spaced apart to form a drainage space therebetween;

b) an inner wall adjacent said outer wall and disposed on top of said plastic bricks;

c) a plurality of plastic palettes disposed on said underground surface of said structure;

d) a non-woven fabric layer covering each of said plastic palettes; and e) a layer selected from the group consisting of mortar and concrete covering said non-woven fabric layer.

2. The damp-proof construction of claim 1 wherein each plastic brick further comprises a hexahedron-shaped brick having a pair of side walls, a pair of end walls, an upper plate, and a chamber formed by said upper plate and said pairs of end walls and side walls, wherein each said end wall and each said side wall has grooves at constant intervals along a length thereof, each said groove extending upwardly from said upper plate.

3. The damp-proof construction of claim 2 wherein grooves in said end walls are shorter than grooves in said side walls.

4. The damp-proof construction of claim 1 wherein each said plastic palette comprises a square plate having a plurality of triangular through openings in spaced apart relationship and a plurality of rectangular openings spaced along a peripheral edge of said plate.

5. The damp-proof construction of claim 4 wherein each said plastic palette further comprises a plurality of holder pipes extending below a bottom surface of each said plastic palette, each said holder pipe including a plurality of reinforcer spacers extending downwardly along a length of each said holder pipe and a plurality of conically-shaped support members, each support member designed to be inserted into a respective said holder pipe, each support member including a support collar around an outer surface thereof to control a support member height when each support member is inserted into a respective said holder pipe.

6. The damp-proof construction of claim 5 wherein said plastic palette further includes a reinforcing frame extending downwardly from a peripheral edge of said square plate.

7. A palette for a damp-proof building construction comprising a square plate having a plurality of triangular through openings in spaced apart relationship, a plurality of rectangular openings spaced along a peripheral edge of said plate, a reinforcing frame extending downwardly from said peripheral edge, a plurality of holder pipes extending below a bottom surface of each said plastic palette, each holder pipe including a plurality of reinforcing spacers extending downwardly along a length of each said holder pipe, and a plurality of conically-shaped support members, each said support member designed to be inserted into a respective said holder pipe, each said support member including a support collar around an outer surface thereof to control a respective said support member height when each support member is inserted into a respective said holder pipe and a reinforcing frame extending downwardly from a peripheral edge thereof.

8. A damp-proof brick for building construction comprising a plastic hexahedron-shaped brick having a pair of side walls, a pair of end walls, upper plate, and a chamber formed by said upper plate, said pairs of end walls and side walls, wherein each said end wall and each said side wall have grooves at constant intervals along a length thereof, each said groove extending upwardly from said upper plate and wherein grooves in said end wall are shorter than grooves in said side wall.

* * * * *